US005318176A

United States Patent [19]

Kaspersen et al.

[11] Patent Number: 5,318,176

[45] Date of Patent: Jun. 7, 1994

[54] RAIL, PREFERABLY WALL RAIL, METHOD FOR THE PRODUCTION HEREOF AND TOOL HEREFOR

[75] Inventors: Anders W. Kaspersen, Fåborgvej; Leif Jacobsen, Strandhuse, both of Denmark

[73] Assignee: Concept Interior A/S, Svendborg

[21] Appl. No.: 847,008

[22] PCT Filed: Oct. 9, 1990

[86] PCT No.: PCT/DK90/00258

§ 371 Date: Apr. 8, 1992

§ 102(e) Date: Apr. 8, 1992

[87] PCT Pub. No.: WO91/04693

PCT Pub. Date: Apr. 18, 1991

[30] Foreign Application Priority Data

Oct. 9, 1989 [DK] Denmark ..... 4990/89

[51] Int. Cl.[5] ..... A47F 5/00

[52] U.S. Cl. ..... 211/87; 211/103; 248/243; 72/326

[58] Field of Search ..... 211/96, 90, 87, 103; 108/108, 109; 248/243; 72/326, 379.2

[56] References Cited

U.S. PATENT DOCUMENTS

| | | | |
|---|---|---|---|
| 1,782,828 | 11/1930 | Mosgrove | 211/96 |
| 2,797,817 | 7/1957 | Shugarman | 211/96 |
| 3,062,570 | 11/1962 | Schwartz | 72/326 X |
| 3,208,505 | 9/1965 | Craemer | 248/300 X |
| 3,561,715 | 2/1971 | Klein | 248/243 |
| 3,851,846 | 12/1974 | Long | 248/188.2 |
| 4,711,420 | 12/1987 | Cowler et al. | 248/243 |

FOREIGN PATENT DOCUMENTS

| | | | |
|---|---|---|---|
| 508477 | 9/1930 | Fed. Rep. of Germany | 72/326 |

*Primary Examiner*—Robert W. Gibson, Jr.

*Attorney, Agent, or Firm*—Antonelli, Terry, Stout & Kraus

[57] ABSTRACT

A wall rail of iron or metal material provided with a series of openings which are produced by pressing back the plate material between a transverse section. Both the pressback parts and the plate parts which remain standing between the transverse sections are configured with an arcuate or polygonal cross-section. The profiled areas extend over the entire breadth of the supporting side, and the material is formed approximately symmetrically out of the plane of the plate.

2 Claims, 6 Drawing Sheets

RAIL, PREFERABLY WALL RAIL, METHOD FOR THE PRODUCTION HEREOF AND TOOL HEREFOR

FIELD OF THE INVENTION

The present invention relates to a rail and, in particular, a wall rail of sheet iron or metal material for enabling a suspension of shelves or the like on brackets, with one end of the bracket being arranged to enter into an engagement with a series of openings produced by pressing back a plate material between transverse sections relative to the plane of the plate material.

BACKGROUND OF THE INVENTION

Rails of the aforementioned type have been proposed which rails are utilized as wall rails or columns for supporting, for example, shelves, cupboards, etc., frequently with the use of a bracket in engagement with the rail.

For example, shelf systems are proposed in U.S. Pat. Nos. 4,098,480 and 4,669,692, where the wall rails have punched rectangular holes at regular intervals, and where the brackets have hook-shaped members for engagement with the holes, whereby a very simple and inexpensive construction is provided. However, a disadvantage of these proposed constructions resides in the fact that relatively thick material must be utilized if the shelves are required to support an acceptable load without deformation of the supporting edges in the punched holes in the wall of the rails. Moreover, the strength of the entire rail is also reduced by the blanking of the holes.

A further disadvantage of the proposed constructions resides in the fact that the wall is visible through the holes in the wall rail and, consequently, the rails must be removed when the wall is to be painted in another color.

In U.S. Pat. No. 4,711,420, a column construction for wall racks is proposed, wherein each column comprises two profiled rails which are clamped or welded together back to back to form the column. The sides of the column are surrounded by further rails which also have a decorative function. Each of the rails is configured with openings at regular intervals along the entire length thereof. Material between the transverse section is pressed back to provide parts with a cross-sectional profile which is angular, substantially at an angle of 90°.

Consequently, the parts turned back-to-back touch and support each other and can be welded together by spot welding, so that the resulting column is rigid and strong, and which, on two sides, can support, for example, shelf brackets or shelves with hook-shaped elements. The material is not pressed symmetrically out from the plane of the plate, so that, in order to avoid the rails from being deformed, side parts are configured which also fit against a corresponding rail when two rails are placed back-to-back. These side parts are also used to secure the surrounding rails, which both cover and hold the column parts together. This construction is very complicated, particularly, for the reasons that each column consists of several parts which must both be formed and joined together. The construction is expensive and requires a very high consumption of material, and the weight is therefore very great per running meter, which contributes towards the making of the construction expensive.

SUMMARY OF THE INVENTION

The object of the present invention is to provide a rail of the aforementioned type which has very high strength characteristics with respect to the material consumption, without this being at the cost of other characteristics.

In accordance with advantageous features of the present invention, a rail of the aforementioned type is provided wherein both the pressed-back plate parts and the plate parts which remain between the sections are formed in such a manner that there cross sectional profile is curved or polygonal in opposite directions.

By virtue of the above noted features of the present invention, it is possible to configure the rail without stretching or blanking the material, and it is only necessary to deform the material. Thus, the problems of the rail becoming crooked or twisted are hereby avoided. The resulting rail has a very low weight per running meter with respect to the characteristics achieved with regard to strength and bearing capacity.

The rail according to the invention can be surface treated industrially, and the configuration ensures that the back wall cannot be seen through the openings.

Furthermore, the rail according to the invention can be used singly as wall rails, or can be joined together in a plurality, for example, two rails back-to-back as a column. The special configuration results in the brackets or other support elements being given the possibility of having a broad contact area with the rail, and thus point loading is avoided.

In accordance with further features of the present invention, the curved or polygonal profiled pieces are arcuate or formed as an equilateral polygon.

By virtue of the last-noted features of the present invention, the rail assumes very high characteristics from the point of view of strength, even in a very thin plate of, for example, ½–1 ½-mm or generally only with difficulty, that a long rail can be configured without it being crooked or slightly twisted. Moreover, this configuration renders a simplification possible in the forming and manufacturing of brackets and other supporting elements which are required to engage the rail.

According to the present invention, the profiled areas of the rail extend over the entire breadth of the supporting side, and the material is formed approximately symmetrically out from a plane of the plate parts.

By virtue of the last-mentioned features of the present invention, quite unusual strength characteristics are achieved, in that a bent edge of 130°–180° is provided in each side of the opening. This gives both a characteristic appearance and very rigid and strong construction which can support five to fifteen times more than if the holes were merely blanked out.

BRIEF DESCRIPTION OF THE DRAWINGS

The present invention will now be described in closer detail with reference to the drawings, wherein.

DETAILED DESCRIPTION

Figure 1:
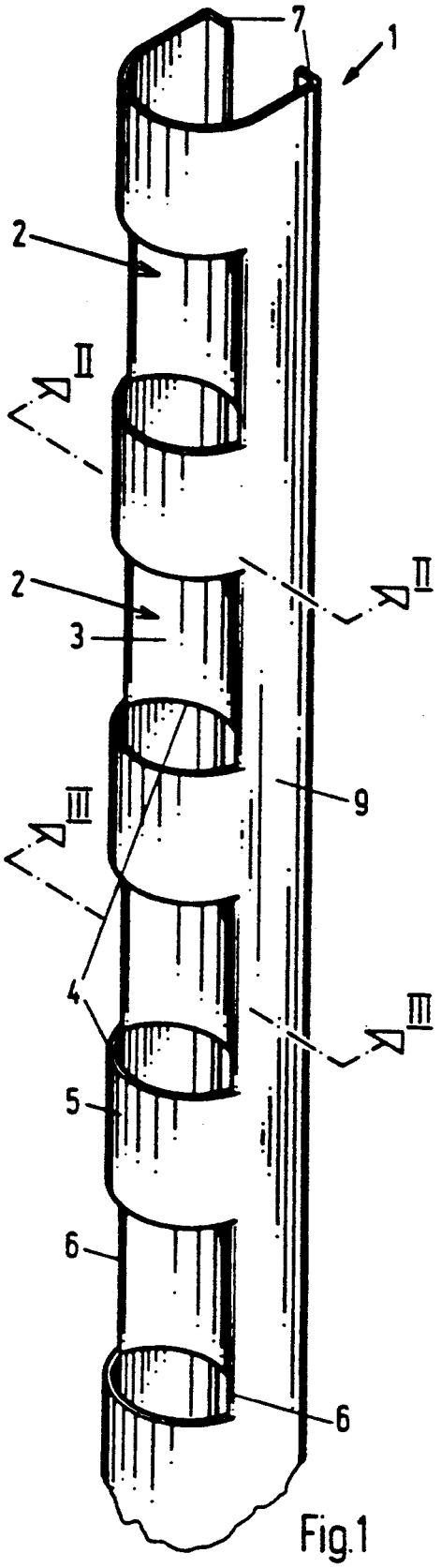
FIG. 1 is a perspective view of a segment of a rail constructed in accordance with the present invention.

Referring now to the drawings wherein like reference numerals are used throughout the various views to designate like parts and, more particularly, to FIG. 1, according to this figure, a segment or portion of a rail generally designated by the reference numeral 1, according to a first embodiment of the present invention, includes material parts 3, which are pressed back or rearwardly, and material parts 5, which are pointing or extending in the forward direction, with both parts 3, 5 having an acute cross-sectional profile but facing in opposite directions so that the concave sides face towards each other. This gives rise to openings 2 between the transverse shear edges 4. At each vertical side edge 6 in the openings there arises a fold area in that the plate material is folded approximately 130°–180°, as shown most clearly in FIGS. 2–4.

In the front of the rail 1 is profiled across the entire breadth, in that the openings 2, except the fold edges 6 in each side have a clearance corresponding to the breadth of the rail 1. The fold edge in each side is approximately twice the thickness of the plate.

Figure 2:
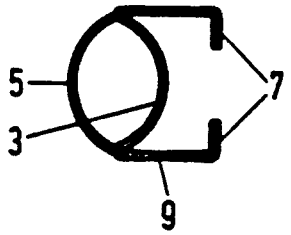
FIG. 2 is a cross-sectional view taken along a line II—II in FIG. 1.
Figure 3:
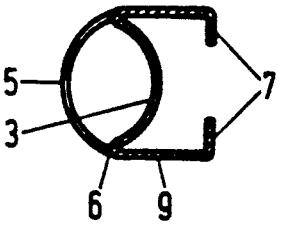
FIG. 3 is a cross-sectional view taken along a line III—III in FIG. 1.
Figure 4:
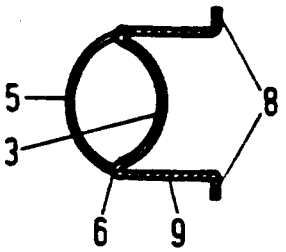
FIG. 4 is a cross-sectional view corresponding to FIG. 3, with a further rail arranged for another form of suspension than that illustrated in FIG. 3.

The depth of the rail 1, the breadth of the sides 9, depends on the desired use and appearance of the rail. FIGS. 1—3 and 4 illustrate different ways in which the rail 1 can be brought to an end on the rearwardly-facing side. In FIGS. 1–3 the sides 9 are brought to an end by being bent inwards, and in FIG. 4 the ends of the sides are bent outwards. The sides 7 and 8 are used, for example, in the mounting of the rail.

Figure 5:
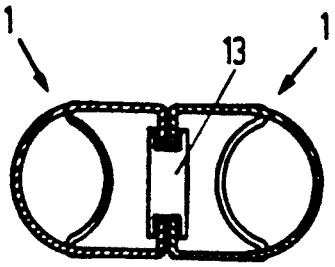
FIG. 5 is a planar cross-sectional area in two rails held together, with the two rails being utilizable as a column.
Figure 6:
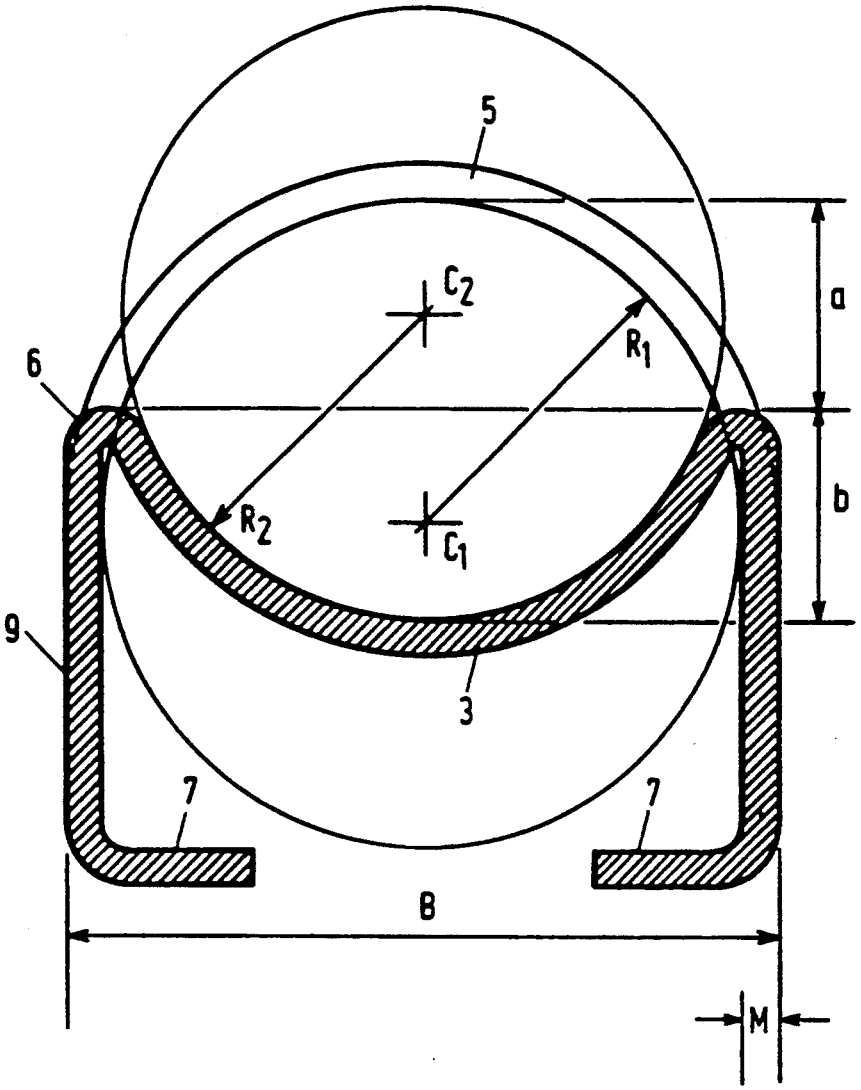
FIG. 6 is a cross-sectional view similar to FIG. 3 but on a larger scale.

FIG. 5 provides an example of how the manner in which two rails 1 can be assembled back-to-back by an internal strip or bracket 13, which, in a concealed manner, couples the rails together to form a column. On a larger scale, FIG. 6 shows the cross-sectional profile of a preferred embodiment of the rail, namely, with arcuate profile parts 3,5. The center for the outwardly-projecting part 5 is C1, and the radius of the concave side is R1. The center for the inwardly-projecting part 3 is C2, and the radius of the concave side is R2. B is the total breadth of the profile, and M is the thickness of the material. The fold edges 6 are shown at both sides. The distances a and b are the distances from the cross-line over the fold edges 6 to the inner side of the parts 5 and 3, i.e. the depth of the concave parts.

The relationships which apply for the cross-sectional profile are as follows:

$$R1 > R2$$

$$R \simeq \frac{B}{2} - M \quad R2 \simeq \frac{B}{2} - M - \frac{2}{3} M$$

$$a + b \simeq \frac{2}{3} R1 + \frac{2}{3} R2$$

As apparent from FIG. 6, R2 must be less than R1.

EXAMPLE

A 19×19 mm rail has a largest outer dimension of 19 mm both in depth and in breadth.

M=0.9 mm iron plate

B=19 mm

R1=8.6 mm

R2=8.0 mm a+b=11.1 mm

Such a rail can thus be produced by bringing together cylindrical forming elements with a diameter of 17.2 mm and 16.0 mm.

Figure 7A:
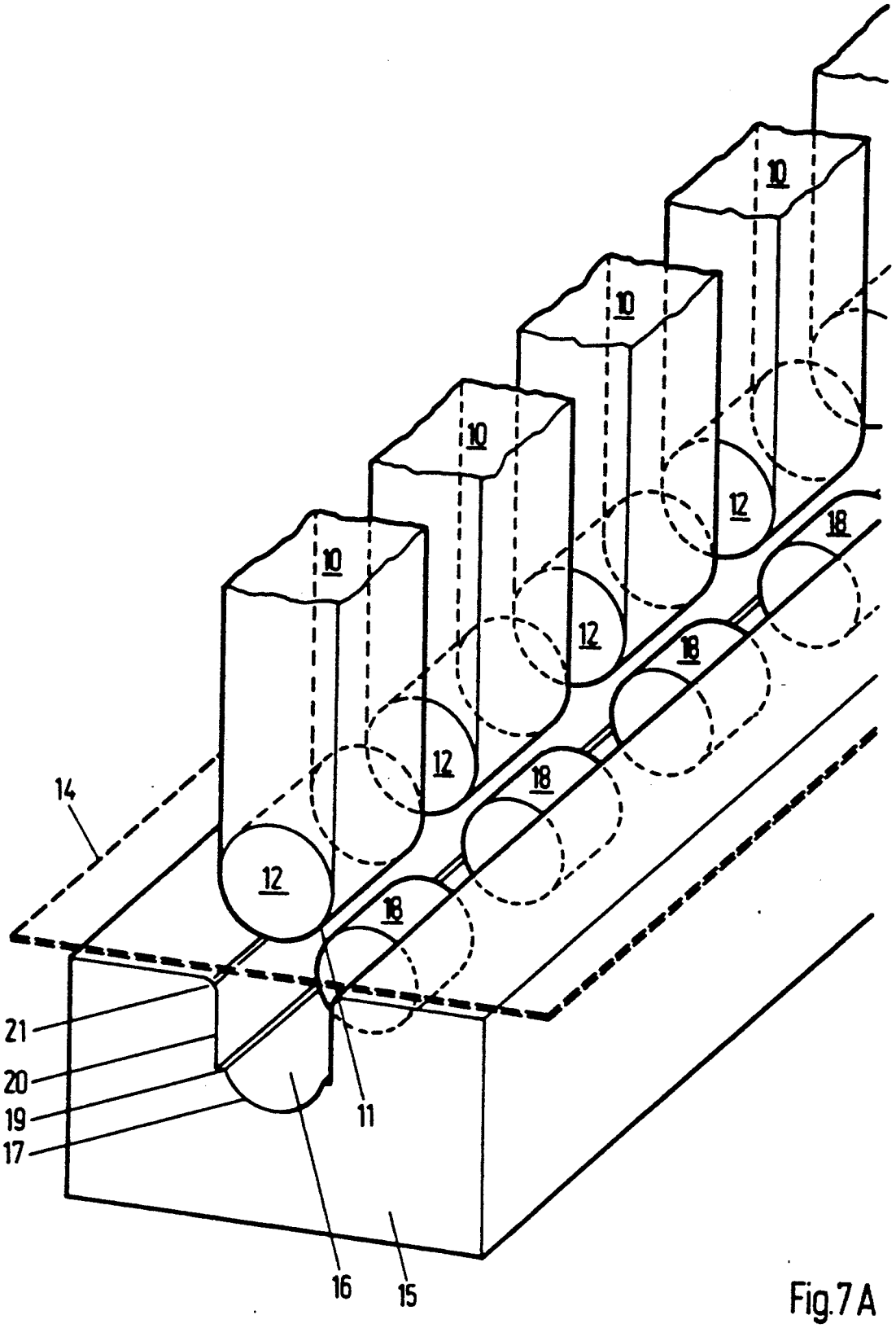
FIG. 7A is a perspective view of a portion of a tool and die arrangement for producing the construction of the present invention.

For example, the profiled front side of a rail 1 as shown in FIG. 1 can be produced with a tool as shown sketched in FIG. 7A. A plate 14, for example, a 0.9 mm thick iron plate, is formed between a female die member 15 and a patrix 10 which, for example, comprises a number of forwardly-projecting punches with cylindrically-rounded forming ends 11 which, for example, are cylindrical steel pieces 12 secured at the forming end.

The female die member 15 comprises a longitudinal channel 16 with, for example, an arcuate bottom 17 and plane side walls 20. The transition between the arcuate bottom 17 and the sides 20 can include a plane area 19 which lies so low that when the tool is in its bottom position, the fold edges 6 and the outwardly-projecting parts 5 of the profile do not make contact with the plane areas 19. At intervals along the channel 16 there are provided cylindrical steel pieces 18, these being disposed and secured in such a manner that they fill out the areas in the axial direction between the male die members 10.

The channel 16 also has a breadth which, is greater than the breadth of the male die members 10, preferably so much broader that there is room for the plate 14 at each side, that is, the total breadth of the channel is approximately twice the plate thickness broader than the male die members 10. The channel 16 also has rounded edges 21 at the upper surface of the female die member.

Figure 7B:
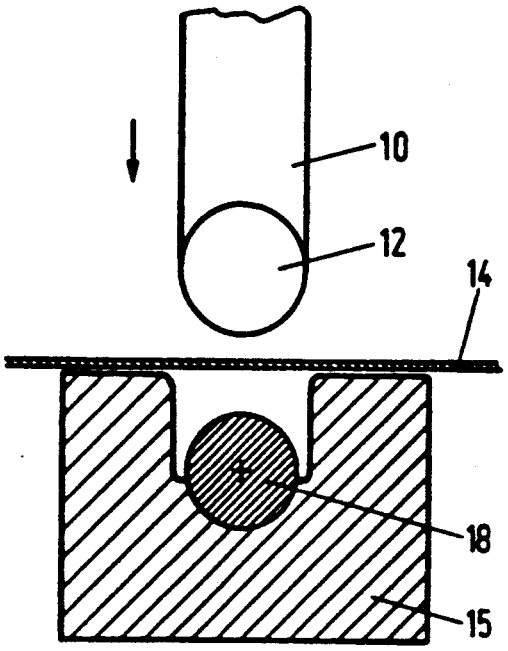
FIGS. 7B–7D are cross-sectional views of the operational states for producing the rail in accordance with the present invention.
Figure 7C:
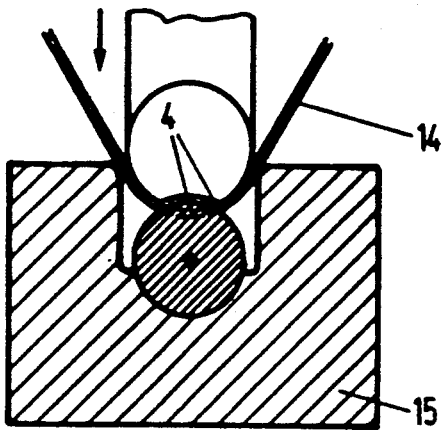
Figure 7D:
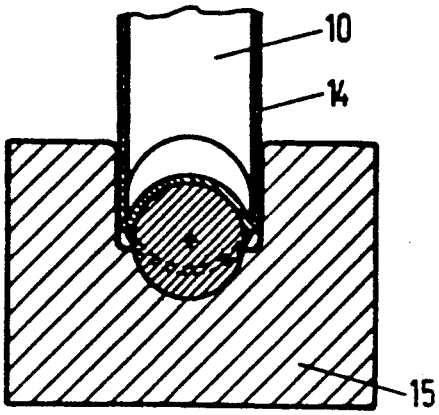

As shown FIGS. 7B–D, such a tool can be used to produce a rail profile as shown in FIG. 1 with one workstroke, in that the front profile of the rail with section 4, openings 2, pressed-back parts 3 and forwardly pointing material section 5 plus folds and parallel sides 9 are all produced in one operation. As apparent from FIG. 1 7D, where the male die members 10 are in a bottom position, the plate 14 is in contact only with the forming tool parts 12 and 18 at the concave sides of the cross-sectional profile of the rail. The actual forming is thus a partly free forming, in that the convex sides of the rail are not in contact with the forming tools.

If it is required to produce rails with other cross-sectional profiles, tools having female and male die members with corresponding cross-sectional profiles are used.

Figure 8:
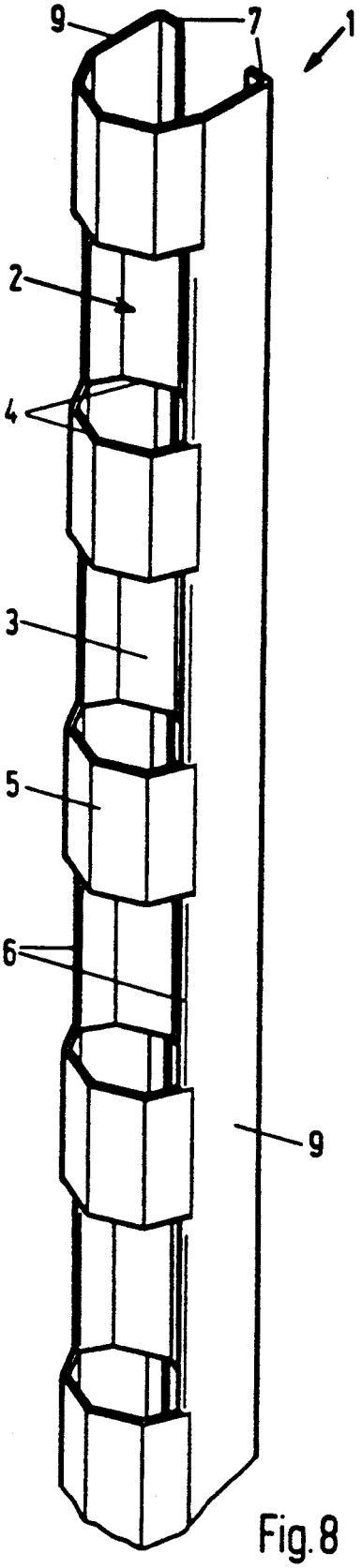
FIG. 8 is a perspective view of a segment or portion of a rail constructed in accordance with a second embodiment of the present invention wherein the cross-sectional profile is an equilateral polygon.
Figure 9:
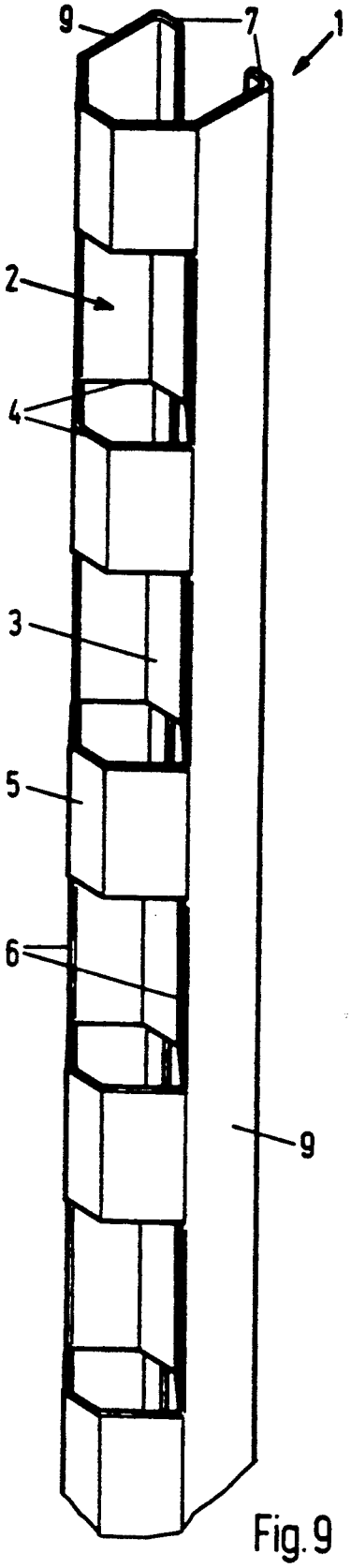
FIG. 9 is a perspective segmental view of a rail according to a third embodiment of the present invention wherein the cross-sectional provide is not an equilateral polygon.

FIGS. 8 and 9 provided examples of a second and a third embodiment of the rail according to the invention, i.e. with a cross-sectional profile which is an equilateral polygon in FIG. 8, and with a cross-sectional profile which is a non-equilateral polygon in FIG. 9. Depending on requirements regarding appearance or concerning the application, the cross-sectional profile of the rail can be configured with a large or a small number of sides in the polygonal cross-sectional profiles. Moreover, a different number of sides can be used in the different areas, in that the cross-sectional profile can be formed in innumerable ways without deviating from the basic idea of the invention.

Figure 10A:
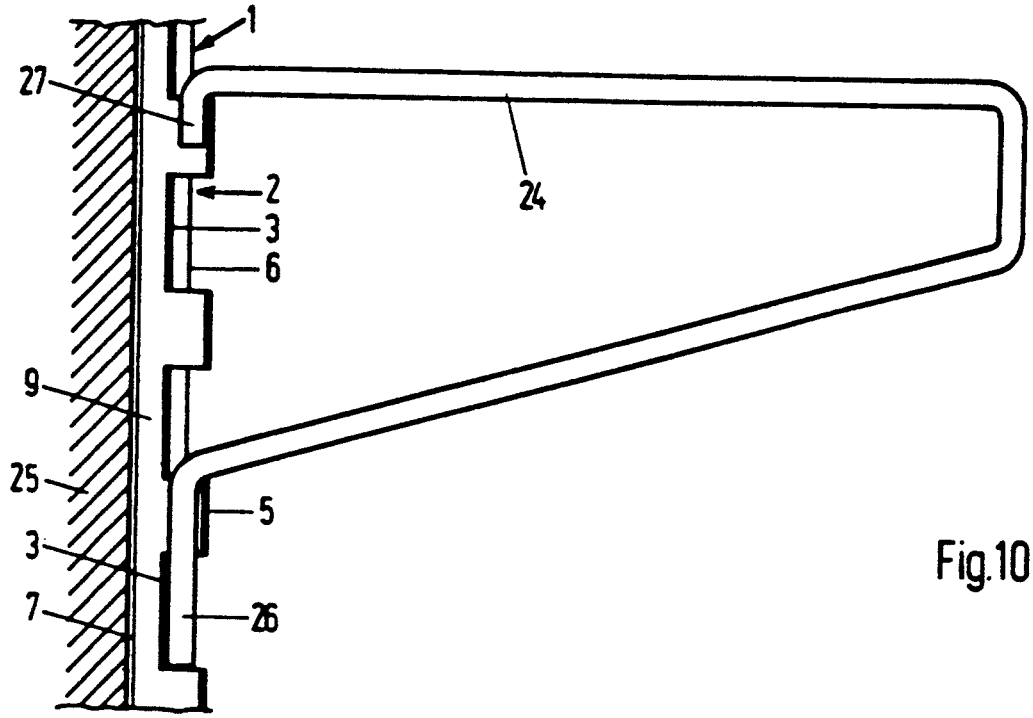
FIGS. 10A and 10B are cross-sectional views illustrating the manner by which a shelf support or bracket engages with a rail constructed in accordance with the present invention.
Figure 10B:
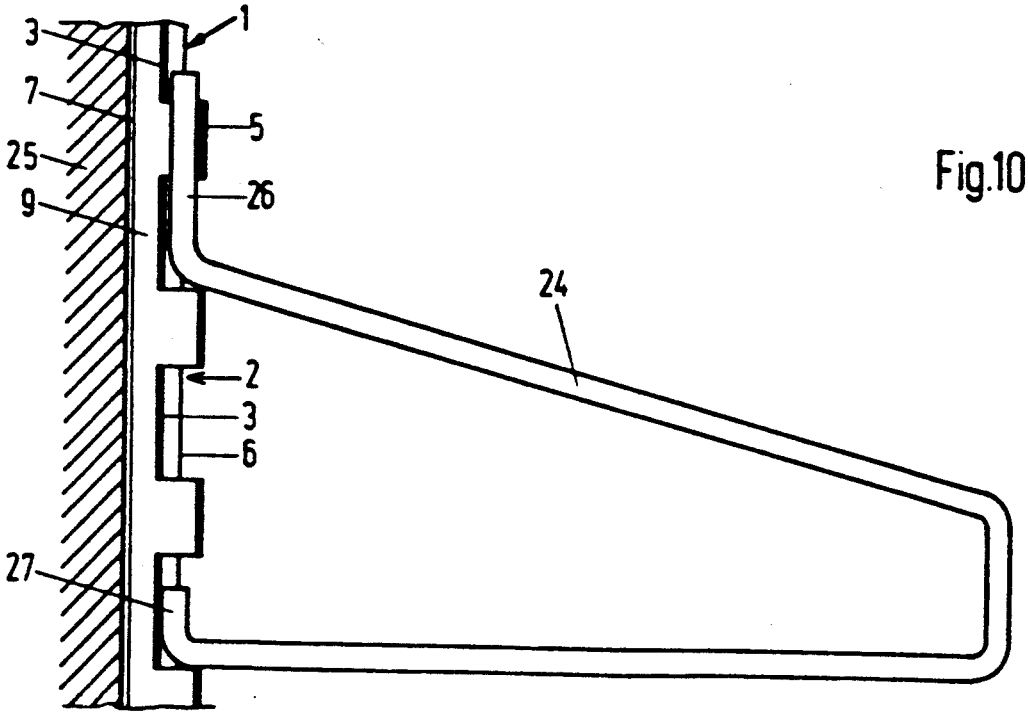

FIGS. 10A and 10B provide an example of manner by which a bracket can be configured and arranged in order for it to enter into engagement with a rail or column according to the invention. The bracket 24 is bent in solid or hollow material, e.g. iron or steel, preferably, with circular cross-sectional profile. The bracket has a hook-shaped bend 26,27 in each end, and also comprises a part which is arranged to extend horizontally. It also has a part which is arranged to extend upwardly or downwardly in an inclined manner, depending how the bracket 24 is turned. This means that the same bracket can be turned as shown both in both FIG. 1OA and 1OB. The rail 1 is shown secured to a wall or the like 25. The bracket 24 is in engagement with the forwardly-facing part 5 and rests against the part 3 which is pressed rearwardly, regardless of how the bracket 24 is turned. Such a bracket 24 enables the suspension of both inclined and horizontal shelves.

FIGS. 1OA and 1OB are merely an example of how a bracket can be configured and suspended in a rail according to the invention. However, from FIG. 10 it will be clear that the bracket 24 rests against the rail in such a manner that there does not arise any point-loading on the rail, but that the load from the bracket (and the shelf) is distributed over a considerable part of the breadth of both the forwardly-facing part 5 and that part 3 which is pressed back.

We claim:

1. A rail of a plate of a metal material for enabling a suspension of shelves by brackets having one end adapted to engage a series of openings produced by rearwardly pressing the plate of metal material between selected transverse sections with respect to a plane of the plate material, wherein both the rearwardly pressed portions of the plate of material and portions of the plate material remaining between the transverse sections are formed in such a manner that a cross-sectional profile thereof is one of curved or polygonal in opposite directions, and wherein the cross-sectional profile extends over an entire breadth of a supporting side of the rail, with the cross-sectional profile being substantially symmetrical with respect to the plane of the plate of metal material.

2. A rail according to claim 1, the curved or polygonal cross-sectional profiles are arcuate or formed as an equilateral polygon.

* * * * *